US005275549A

United States Patent [19]

Yamasaki

[11] Patent Number: 5,275,549

[45] Date of Patent: Jan. 4, 1994

[54] MOLDING APPARATUS WITH DEGASSING MECHANISM

[75] Inventor: Kojiro Yamasaki, Kobe, Japan

[73] Assignee: Yamasaki Kosakusho Co., Ltd., Kobe, Japan

[21] Appl. No.: 874,471

[22] Filed: Apr. 9, 1992

[30] Foreign Application Priority Data

May 24, 1991 [JP] Japan ..... 3-149674

[51] Int. Cl.[5] ..... B29C 45/34

[52] U.S. Cl. ..... 425/546; 264/102; 264/328.12; 425/573; 425/812

[58] Field of Search ..... 425/546, 812, 573; 264/101, 102, 328.12

[56] References Cited

U.S. PATENT DOCUMENTS 3,349,833 10/1967 Hodler ..... 425/812
5,092,759 3/1992 Lichtinger et al. ..... 425/812

FOREIGN PATENT DOCUMENTS 0441289 8/1991 European Pat. Off. .
3101841 11/1981 Fed. Rep. of Germany .
658811 12/1986 Switzerland .
1250468 10/1971 United Kingdom .

*Primary Examiner*—Tim Heitbrink
*Attorney, Agent, or Firm*—Kanesaka and Takeuchi

[57] ABSTRACT

The molding apparatus of the invention includes a molding cavity, a flow regulating portion and a degassing portion. The flow regulating portion is situated in a die to communicate between the molding cavity and the degassing portion and regulates molten material to pass through the flow regulating portion without forming turbulent flow therein. Therefore, the molten material enters into the degassing portion throughout the entire width of the degassing portion. Because of the flow regulating portion, the degassing portion may be made small, but the molten material can be properly solidified at the degassing portion without forming partial flow. Gas or air can be sufficiently removed from the die.

6 Claims, 2 Drawing Sheets

MOLDING APPARATUS WITH DEGASSING MECHANISM

BACKGROUND OF THE INVENTION AND RELATED ART STATEMENT

The present invention relates to a molding apparatus for die casting, which is provided with an improved degassing mechanism for allowing gas inside a cavity of a mold to be smoothly exhausted therefrom.

It has been known that a degassing groove is formed in a mold for exhausting air or gas from a cavity inside the mold when a molten material is supplied to the die for die casting. After the molten material is filled in the cavity, the degassing groove is closed by the molten material, and the molten material in the die is cooled.

FIG. 1 shows a conventional die casting apparatus 10, which is formed of a fixed die 11 and a movable die 12. The fixed die 11 includes a sleeve 13 with a piston 14, by which a molten material is supplied inside the apparatus 10. The movable die 12 includes a sprue runner 15 and a cavity 16, which is communicated with the atmosphere through an outlet 17, a concave 18 and a degassing portion 19.

In one example, the degassing portion 19 has a height of 0.05–0.25 mm with respect to the fixed die 11, a width of 10–40 mm, and a length of about 100 mm between the concave 18 and an outside of the die 12. The degassing portion 19 may be tapered outwardly such that a height relative to the fixed die 11 at a side of the concave 18 is the largest.

When the apparatus 10 is used, the movable die 12 is attached to the fixed die 11, and a molten material is supplied to the sleeve 13. As the piston 14 is moved forwardly, the molten material is supplied to the cavity 16 through the sprue runner 15, while air or gas inside the cavity 16 is exhausted through the outlet 17, the concave 18 and the degassing portion 19. After the cavity 16 is filled with the molten material, the molten material enters into the outlet 17, the concave 18 and the degassing portion 19, and is solidified thereat.

When the molten material enters into the outlet 17, however, since the outlet 17 is wide, the molten material does not flow linearly. The molten material flows obliquely or freely in the outlet 17, and as a leading portion of the molten material reaches a forward end of the degassing portion 19, the molten material solidifies thereat in order.

As the molten material does not arrive instantaneously along the entire width of the forward end of the degassing portion 19, the molten material solidifies partly at the forward end of the degassing portion 19. Therefore, the molten material subsequently supplied or arrived at the degassing portion 19 flows to portions where there is no hardened material. Namely, it causes partial flow or unbalanced flow of the molten material. Further, the molten material may partly blow up from the degassing portion 19.

In order to obviate these problems, the conventional molding apparatus has been formed such that the degassing portion 19 is made to have a small height of about 0.1 mm, and a long length of about 100 mm.

In the molding apparatus, lubricating oil is generally applied inside the sleeve 13 in order to prevent burning of the piston 14 inside the sleeve 13. When the degassing portion 19 is formed as explained above, the oil may cause another problem.

Namely, when the molten material is supplied to the sleeve 13, the lubricating oil evaporates by heat, i.e. about 700° C., of the molten material, and the evaporated oil flows outwardly through the degassing portion 19. However, the temperature at the degassing portion 19 is low, i.e. about 200° C., and the degassing portion 19 is very narrow in height and long in length. Therefore, while the evaporated oil flows through the degassing portion 19, the evaporated oil is condensed thereat and becomes oil with high stickiness. Also, a part of the evaporated oil adheres to the inside of the cavity.

As a result, the degassing portion 19 is clogged by the condensed oil. Since the degassing portion 19 is very small in height, even if pressure of 500 kg/cm$^2$ is applied from the inside of the mold 10, the clogged oil may not be blown up from the degassing portion 19.

In the conventional apparatus, while the degassing portion 19 is clogged by oil, the molten material is supplied to the cavity 16. Therefore, high temperature and pressure are applied to the lubricating oil adhered to the surface of the cavity 16.

As a result, the oil in the cavity 16 is decomposed to form a large amount of hydrogen and carbon. Namely, hydrogen gas is formed inside the cavity 16, which is mixed with the molten material to form pores, swelling and so on. Also, carbon formed by decomposition of oil makes the product black.

The present invention has been made in view of the above drawbacks and to solve the problems.

Accordingly, one object of the present invention is to provide a molding apparatus, which can easily make a molding product without pores, swelling and so on.

Another object of the invention is to provide a molding apparatus as stated above, wherein flow of a molten material is properly regulated.

A further object of the invention is to provide a molding apparatus as stated above, wherein the size of the apparatus is made compact.

A still further object of the invention is to provide a molding apparatus as stated above, which can be formed easily and economically without substantial change of the conventional apparatus.

Further objects and advantages of the invention will be apparent from the following description of the invention.

SUMMARY OF THE INVENTION

In accordance with the present invention, a molding apparatus is basically formed of a die, a molding cavity formed in the die, a flow regulating portion formed in the die to communicating with the molding cavity, and a degassing portion formed in the die for communicating between the flow regulating portion and the atmosphere.

In the molding apparatus of the invention, when a molten material enters into the flow regulating portion after the molding cavity is filled with the molten material supplied thereto, the flow regulating portion allows the molten material to pass linearly through the flow regulating portion without forming turbulent flow therein. After the molten material passes through the flow regulating portion, the molten material enters linearly into the degassing portion as it is, throughout the entire width of the degassing portion without forming turbulent flow therein.

The molten material reaches an end of the degassing portion substantially at the same time throughout the entire width thereof, and gradually solidifies at the degassing portion without forming partial flow of the molten material or blowing up of the molten material. In the present invention, the outer end of the degassing portion may be made relatively wide, which prevents clogging of the degassing portion by evaporated oil. Even if evaporated oil clogs at the degassing portion, the clogged oil is automatically removed by air or gas ejected from the cavity.

Accordingly, air or gas in the cavity is smoothly exhausted from the cavity through the degassing portion. Even if lubricating oil is left in the cavity and is evaporated by the molten material, the evaporated oil is smoothly exhausted from the molding apparatus and does not substantially remain inside the cavity.

Further, since the flow regulating portion is formed, it is unnecessary to form a long degassing portion. The size of the molding apparatus may be formed compact.

The molding apparatus of the invention may further include a concave between the flow regulating portion and the degassing portion. An excess amount of the molten material is retained therein.

The flow regulating portion is formed of a plurality of elongated grooves situated parallel to each other. The molten material passes through the respective elongated grooves to flow linearly without affecting to each other. Therefore, turbulent flow is not formed at the flow regulating portion, and the molten material is linearly supplied to the degassing portion.

The width of the flow regulating portion is substantially the same as that of an inner portion of the degassing portion. Preferably, each elongated groove is formed to have a width increasing gradually from a side of the cavity to a side of the concave.

Accordingly, the molten material is supplied to the degassing portion while the molten material is spreading in the lateral direction in the flow regulating portion. When the molten material enters into the degassing portion, the molten material is spread widest, wherein the molten material ejected from the respective grooves contacts to each other without spreading laterally any more, and the molten material flows forward linearly. The movement, of the molten material is stopped and the material gradually solidifies at the degassing portion.

DETAILED DESCRIPTION OF PREFERRED EMBODIMENTS

Figure 1:
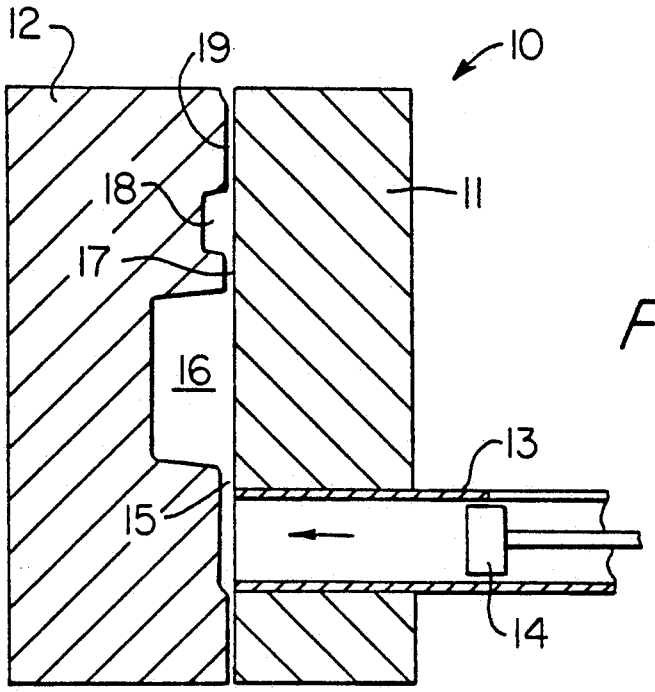
FIG. 1 Prior Art
FIG. 1 is an explanatory section view for showing a conventional molding apparatus.
Figure 2:
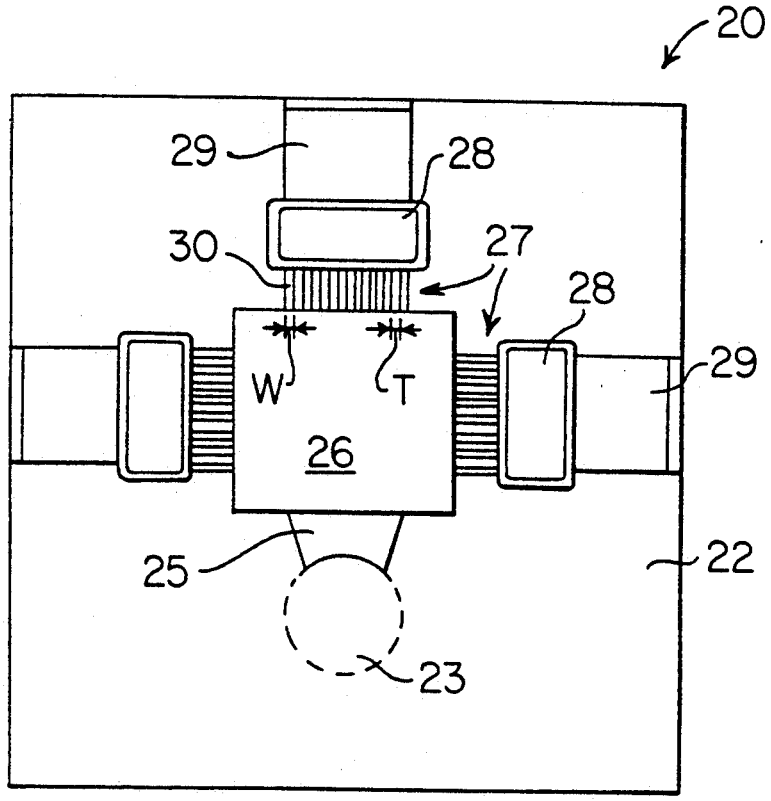
FIG. 2 is a plan view of a moving die of a first embodiment of the molding apparatus of the invention.
Figure 3:
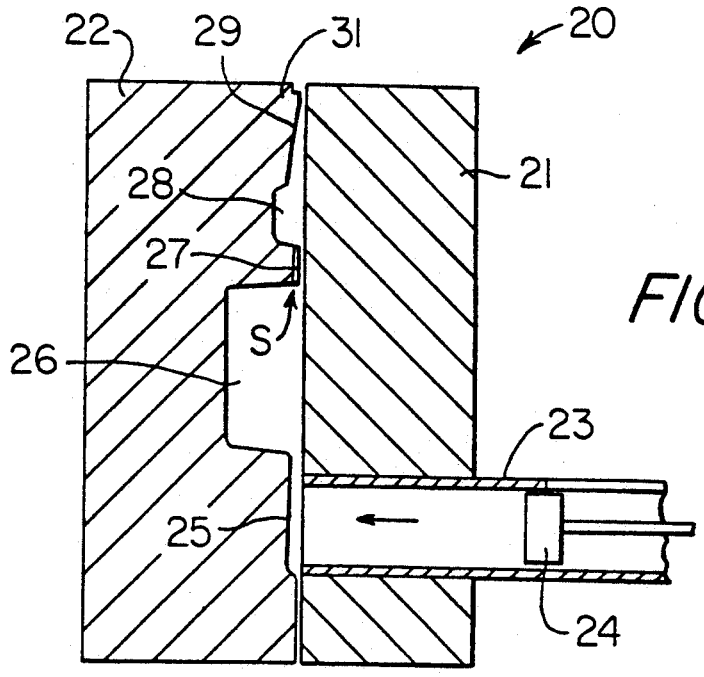
FIG. 3 is an explanatory section view of the first embodiment of the molding apparatus of the invention.

Referring to FIGS. 2 and 3, a first embodiment 20 of the molding apparatus of the invention is shown. The molding apparatus 20 includes a fixed die 21, and a movable die 22. The fixed die 21 includes a sleeve 23 and a piston 24, while the movable die 22 includes a sprue runner 25, a cavity 26, a concave 28 and a degassing portion 29, as in the conventional molding apparatus.

In the conventional apparatus 10, the outlet 17 is formed between the cavity 16 and the concave 18, but in the molding apparatus 20, a flow regulating portion 27 is formed between the cavity 26 and the concave 28. The flow regulating portion 27 regulates flow of a molten material passing therethrough.

As clearly shown in FIG. 2, the flow regulating portion 27 is formed of a plurality of grooves 30 extending linearly between the cavity 26 and the concave 28. In order to properly regulate flow of the molten material, the length of the groove 30 is made longer than the width of the groove 30.

In the embodiment as shown in FIG. 2, the length of the flow regulating portion 27 between the cavity 26 and the concave 28 is 5 mm; the width W of the groove 30 is 1.5 mm; the distance T between the grooves 30 is 1 mm; and the space S between the fixed mold 21 and the bottom of the groove 30 is 1.2 mm. The top portions of the grooves 30 are situated away from the fixed mold 21 at a distance about 0.1–0.2 mm so that the grooves 30 does not contact the mixed mold 21. Eight grooves 30 are formed in total.

The degassing portion 29 has a flat portion 31 at an outer end and is tapered toward the flat portion 31 from an inner end at a side of the concave 28. In the embodiment as shown in FIG. 2, the distance relative to the fixed die 21 at the flat portion 31 is 0.15 mm; the distance relative to the fixed die 21 at the inner end is 1.2 mm; the angle from the flat portion 31 to the inner end is about 10 degrees; and the length of the flat portion 31 is 2 mm.

When the mold 20 is used, the movable die 22 is attached to the fixed die 21. Then, a molten material is supplied into the sleeve 23 and is pushed inwardly by the piston 24. Accordingly, the molten material is supplied into the cavity 26 through the sprue runner 25, while air or gas in the cavity 26 is exhausted through the flow regulating portion 27 and the degassing portion 29.

When the cavity 26 is substantially filled with the molten material, the molten material enters into the flow regulating portion 27. Since the flow regulating portion 27 is formed of a plurality of grooves 30, the molten material flows in the grooves 30 without lateral movement.

Namely, even if the molten material does not enter smoothly into the grooves 30, the molten material in the respective grooves 30 flows smoothly and linearly. The molten material does not flow substantially across the grooves 30. Even if the molten material in the condition of a turbulent flow enters into the grooves, the molten material is regulated to flow linearly.

The molten material enters into the grooves 30 substantially at the same time throughout the entire width of the flow regulating portion 27 and passes therethrough.

Thereafter, the molten material hits the tapered surface of the degassing portion 29 and flows toward the outer end in the degassing portion 29. The leading portion of the molten material is cooled by air through an outlet of the degassing portion 29 and is solidified without ejecting.

Since the leading portion of the molten material substantially equally advances in the degassing portion 29, the leading portion of the molten material is solidified substantially throughout the entire area of the outlet of the degassing portion 29. Therefore, the molten material inside the molding apparatus does not partly flow.

When the molten material is supplied into the cavity, oil inside the cavity may evaporate. However, the evaporated oil is smoothly exhausted through the flow regulating portion 27 and the degassing portion 29. Therefore, no gas or air is retained inside the cavity when the molding is completed. Air or gas is not formed inside the molding product.

Further, in the present invention, since the molten material is equally cooled at the degassing portion 29, the molten material does not blow up. As a result, the size of the degassing portion is shortened, so that overall size of the molding apparatus is made compact.

Figure 4:
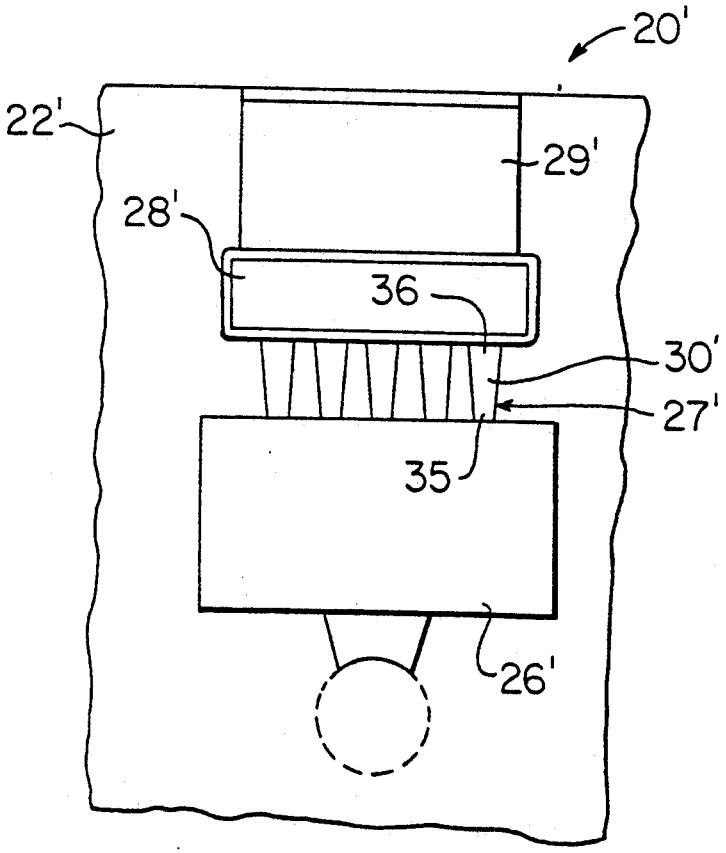
FIG. 4 is an enlarged plan view for showing a part of a moving die of a second embodiment of the molding apparatus of the invention.

FIG. 4 shows a second embodiment 20' of the molding apparatus of the invention. The molding apparatus 20' includes a fixed die, and a movable die 22' with a cavity 26', a flow regulating portion 27', a concave 28' and a degassing portion 29', as in the molding apparatus 20. Since the fixed die in the molding apparatus 20' is the same as the fixed die 21 in the molding apparatus 20, the fixed die is not shown in the apparatus 20'.

In the molding apparatus 20', however, the flow regulating portion 27, is provided with a plurality of tapered grooves 30'. Each groove 30, has an inner portion 35 and an outer portion 36. The width at the inner portion 35 is narrower than that at the outer portion 36, while the depth at the inner portion 35 is deeper than that at the outer portion 36. The width and the depth are gradually changed.

Therefore, when the molten material flows from the cavity 26' to the degassing portion 29', the molten material is oriented toward the fixed die 21' by the inclined bottom surface and is spread widely by the inclined side surfaces. The molten material ejecting from the respective grooves 30' smoothly and equally enters into the degassing portion 29' throughout the entire width thereof. The apparatus 20' operates as in the apparatus 20.

In the present invention, the molten material can be supplied equally and smoothly into the degassing portion throughout the entire area thereof. Therefore, partial flow or blowing up of the molten material is prevented. Also, air or gas is not contained in the product.

While the present invention has been explained with reference to the specific embodiments of the invention, the explanation is illustrative and the invention is limited only by the appended claims.

What is claimed is:

1. A molding apparatus comprising, a die, a molding cavity formed in the die for casting a molten material therein, a flow regulating portion formed in the die to communicate with the molding cavity, said flow regulating portion being formed of a plurality of elongated grooves situated parallel to each other and allowing, when the molten material enters into the flow regulating portion after the molding cavity is filled with the molten material supplied thereto, the molten material to pass through the respective elongated grooves not to form turbulent flow therein, a degassing portion formed in the die for communicating between the flow regulating portion and atmosphere, said molten material, after passing through the flow regulating portion, entering into the degassing portion without forming turbulent flow throughout an entire width of the degassing portion to thereby provide an improved casting material, and a concave situated between the flow regulating portion and the degassing portion for retaining the molten material therein.

2. A molding apparatus according to claim 1, wherein said degassing portion includes an outlet having a height and a width and communicating with said atmosphere, and an inner portion having a height and a width and communicating with the concave, said widths of the outlet and the inner portion being the same, and said height of the outlet being lower than that of the inner portion and gradually decreasing from the inner portion to the outlet to form a tapered surface.

3. A molding apparatus according to claim 2, wherein said flow regulating portion has a width substantially the same as the width of the inner portion of the degassing portion.

4. A molding apparatus according to claim 1, wherein each elongated groove of the flow regulating portion includes a first side facing the cavity and having a width and a depth, and a second side facing the concave and having a width and a depth, said width of the elongated groove gradually increasing from the first side to the second side and the depth of the elongated groove gradually increasing from the second side to the first side so that the molten material can smoothly enter into the degassing portion from the cavity through the flow regulating portion.

5. A molding apparatus according to claim 1, wherein said molding apparatus includes a fixed die and a movable die moved relative to the fixed die, said flow regulating portion and degassing portion being defined between the fixed die and the movable die.

6. A molding apparatus comprising, a die, a molding cavity formed in the die for casting a molten material therein, a flow regulating portion formed in the die to communicate with the molding cavity, said flow regulating portion being formed of a plurality of elongated grooves situated substantially parallel to each other and allowing, when the molten material enters into the flow regulating portion after the molding cavity is filed with the molten material supplied thereto, the molten material to pass through the respective elongated grooves not to form turbulent flow therein, and a degassing portion formed in the die for communicating between the flow regulating portion and atmosphere, said molten material, after passing through the flow regulating portion, entering into the degassing portion without forming turbulent flow throughout an entire width of the degassing portion to thereby provide an improved casting material.

* * * * *